US006399930B2

(12) United States Patent
Day et al.

(10) Patent No.: US 6,399,930 B2
(45) Date of Patent: Jun. 4, 2002

(54) COMBINATION CONVECTION/ MICROWAVE OVEN

(75) Inventors: William Day; David Harter, both of New Port Richey; Paul Molloy, Clearwater, all of FL (US)

(73) Assignee: The Garland Group, Freeland, PA (US)

( * ) Notice: Subject to any disclaimer, the term of this patent is extended or adjusted under 35 U.S.C. 154(b) by 0 days.

(21) Appl. No.: 09/900,228

(22) Filed: Jul. 6, 2001

Related U.S. Application Data

(63) Continuation-in-part of application No. 09/612,167, filed on Jul. 8, 2000.

(51) Int. Cl.[7] ..... H05B 6/80

(52) U.S. Cl. ..... 219/681; 219/400; 219/685; 219/748; 219/762; 219/757; 126/21 A

(58) Field of Search ..... 219/681, 685, 219/682, 702, 746, 748, 750, 751, 762, 756, 763, 757, 718, 400; 126/21 A; 99/451

(56) References Cited

U.S. PATENT DOCUMENTS 3,569,656 A * 3/1971 White et al. ..... 219/702
4,283,614 A * 8/1981 Tanaka et al. ..... 219/681
4,332,992 A * 6/1982 Larsen et al. ..... 219/681
4,335,290 A * 6/1982 Teich ..... 219/681
4,358,653 A 11/1982 Weiss ..... 219/10.55 B
4,366,357 A * 12/1982 Satoh ..... 219/682
4,392,038 A 7/1983 Day et al. ..... 219/10.55 D
4,410,779 A 10/1983 Weiss ..... 219/10.55 F
4,430,541 A 2/1984 Day ..... 219/10.55 R
4,691,088 A * 9/1987 Eke ..... 219/681

FOREIGN PATENT DOCUMENTS

JP 2-298729 * 12/1990 ..... 219/681

* cited by examiner

*Primary Examiner*—Philip H. Leung
(74) *Attorney, Agent, or Firm*—Ohlandt, Greeley, Ruggiero & Perle, LLP

(57) ABSTRACT

A combination convection/microwave oven in which a food product is cooked by microwave energy and by a heated airflow provided by a thermal energy source and a blower. The oven is capable of cooking food in a microwave reflective pan. Microwave energy enters the oven below the pan and is guided to a spacing between the pan and oven sides and then reflected by the sides and top of the oven to the food product in the pan. The heated airflow is laminar with an upper layer and a lower layer. The pan is positioned at about the interface of the two layers so that the upper layer is incident on the food product and the lower layer is incident on the bottom of the pan.

38 Claims, 13 Drawing Sheets

COMBINATION CONVECTION/ MICROWAVE OVEN

This application is a continuation-in-part of application, Ser. No. 09/612,167, filed Jul. 8, 2000 for "Combination Convection/Microwave Oven Controller".

BACKGROUND OF THE INVENTION

This invention relates to a combination convection/microwave oven and, in particular, to a convection/microwave oven that is capable of cooking food products by convection energy alone or by a combination of convection and microwave energy.

It is customary in the food service industry to use convection ovens to cook food items, such as bakery products, meat products, vegetable products and the like. It is also customary to use standard cooking utensils, such as an one-half size standard restaurant pan.

Ovens that use both microwave energy and thermal energy transferred by convection are described in U.S. Pat. Nos. 4,358,653, 4,392,038 and 4,430,541. For example, U.S. Pat. No. 4,430,541 discloses an oven having a source of microwave energy disposed in a bottom of the oven's cooking chamber and a blower arranged in a side wall to produce a heated airflow. A food product in a container is situated above the microwave source and in the path of the heated airflow. In ovens of this type, the container is positioned in the microwave energy pattern so that substantially all of the microwave energy is incident on the bottom of the container.

A combination oven in which the effect of reflected microwave energy is diminished is described in U.S Pat. No. 4,410,779. The oven has a microwave coupler that produces a heating pattern in which the major portion of microwave energy impinges directly on a food body and is substantially absorbed thereby, before reflection from the oven walls. For the circumstance where there is no food body, the food body is small or the food body is positioned on a metal dish, the reflected radiation has a substantial phase cancellation in the coupler and is re-reflected back into the cooking chamber. To further reduce the effect of reflected microwave energy, the oven walls are constructed of a material that partially absorbs the microwave energy so as to prevent the build up of high intensity field patterns in the oven.

Another combination oven is described in U.S. Pat. No. 4,691,088. This oven uses a pair of stacked trays with microwave energy being introduced to the cooking cavity via the bottom thereof. Power transfer in the oven is automatically responsive to the dielectric load of the food. A forced hot air system blows hot air into the cavity so as to impinge upon the food from above. This oven has a singular purpose to cook food solely by a combination of microwave energy assisted by forced hot air or convection. It has no capability to operate solely in a convection mode. In addition, this oven situates the lower tray at distances from the bottom of the cavity that result in extremely poor transfer of microwave energy to food on the tray. In addition, this oven is incapable of cooking food items without the use of a specially designed rack and tray.

Microwave energy can thaw and cook food products rapidly, but it generally does not provide surface finishing, browning, or other characteristics provided by cooking in an oven environment. Accordingly, microwave ovens with added thermal convection energy have become popular in the restaurant industry. When prior art combination convection/microwave ovens have been used to cook frozen food products, such as biscuits, pies and other bakery goods, dark spots and other non-uniformities often form on the food product. Food products with dark spots are unsightly and, therefore, unpalatable to customers.

The dark spots are formed due to non-uniform energy transfer to and within the food product during the cooking process. The temperature of a frozen food product, for example, can be non-uniform due to conditions existing in the freezer, to non-uniformity of the food product itself, to the package that contains the food product and/or to conditions that occur in the oven. When thawing and/or cooking a frozen food product in prior art ovens, the bottom of the product is warmed by the direct impingement of the microwave energy. However, the top and sides of the food product are being warmed by the heated airflow. The frozen food product cools the heated airflow so as to affect the cooking or thawing temperature of the top and sides. This effect is known as the chill factor as it is similar to the wind chill factor produced by wind on a cold day. As the food product continues to thaw and then to cook, the sides and top remain cooler than the bottom and, thus, enhance the formation of the dark spots or other indications of non-uniform cooking.

Additionally, prior art combination convection/microwave ovens require the use of microwave transparent cooking containers, such as those made with ceramic or glass. This reduces the flexibility of means of thermal transfer and may affect the characteristics of the cooked products.

Thus, there is a need for a combination convection/microwave oven that can rapidly thaw, cook and/or brown food products with increased uniformity of interior and exterior properties.

There is also a need for a combination convection/microwave oven that is capable of cooking food products situated on a microwave reflective dish or pan.

There is also a need for a combination oven that can operate solely in a convection mode or in a combined convection and microwave mode.

SUMMARY OF THE INVENTION

A combination oven of the present is operable in a normal cook mode to cook food in a normal cook time and in a fast cook mode to cook food in a faster time. When in the normal cook mode, the oven uses only convection heat. When in the fast cook mode, the oven uses both convection heat and microwave heat.

According to one aspect of the invention, the convection heat is a heated airflow that is circulated through a cooking chamber that is in fluid communication with a plenum. The heated airflow is formed as a laminar pattern that has a first laminar air stream above the rack and a second laminar air stream below the rack. At least one of the laminar air streams has a pair of loops that share a common path toward an egress port area. The laminar air streams are created by spaced apart ingress port areas for each laminar air stream and a common egress port area.

According to another aspect of the invention, the microwave energy is introduced through a bottom of a cooking chamber. A rack is disposed in the near field of the microwave energy at a height above the cooking chamber bottom such that a random wave guide is formed between the chamber bottom and the bottom of a microwave reflective pan. The random wave guide directs the microwave energy via a spacing around the pan into a region above the rack where it is reflected by the chamber walls and top to impinge upon a food product in the pan from its sides and top. The chamber walls, top and bottom are highly microwave reflective. The height is preferably in a range of about 2.0 inches to about 3.25 inches.

According to yet another aspect of the invention, a stirrer distributes the microwave energy uniformly in cooking chamber to avoid hot spots forming on the food products.

The oven of the invention is extremely flexible as the pan may be a one-half size standard restaurant pan. On the other hand, the food may be placed directly on the rack or in a microwave transparent container and still be cooked by microwave energy and convection heat in a fast cook mode.

According to the method of the invention, the microwave energy is directed between the chamber bottom and the bottom of the reflective pan and through a spacing about the pan to a region above the pan. Hot air is circulated above and below the pan. According to another aspect of the method of the invention, microwave energy is introduced into the cooking chamber and hot air is circulated through the cooking chamber in a laminar airflow pattern. The laminar airflow has one laminar air stream above the level and second laminar air stream below the level.

BRIEF DESCRIPTION OF THE DRAWING

Other and further objects, advantages and features of the present invention will be understood by reference to the following specification in conjunction with the accompanying drawings, in which like reference characters denote like elements of structure and.

DESCRIPTION OF THE INVENTION

Figure 1:
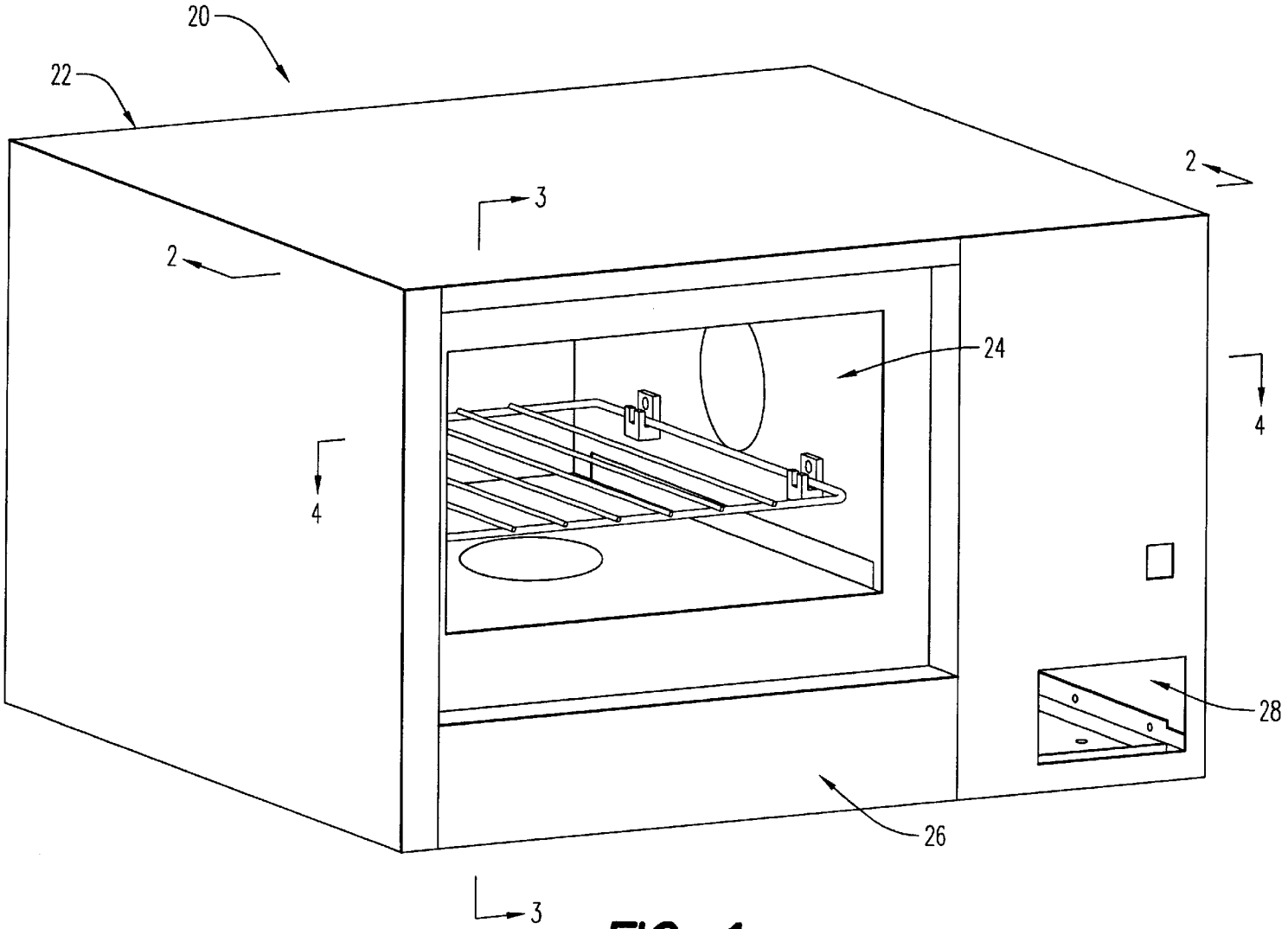
FIG. 1 is a perspective view of a combination convection/microwave oven of the present invention.
Figure 2:
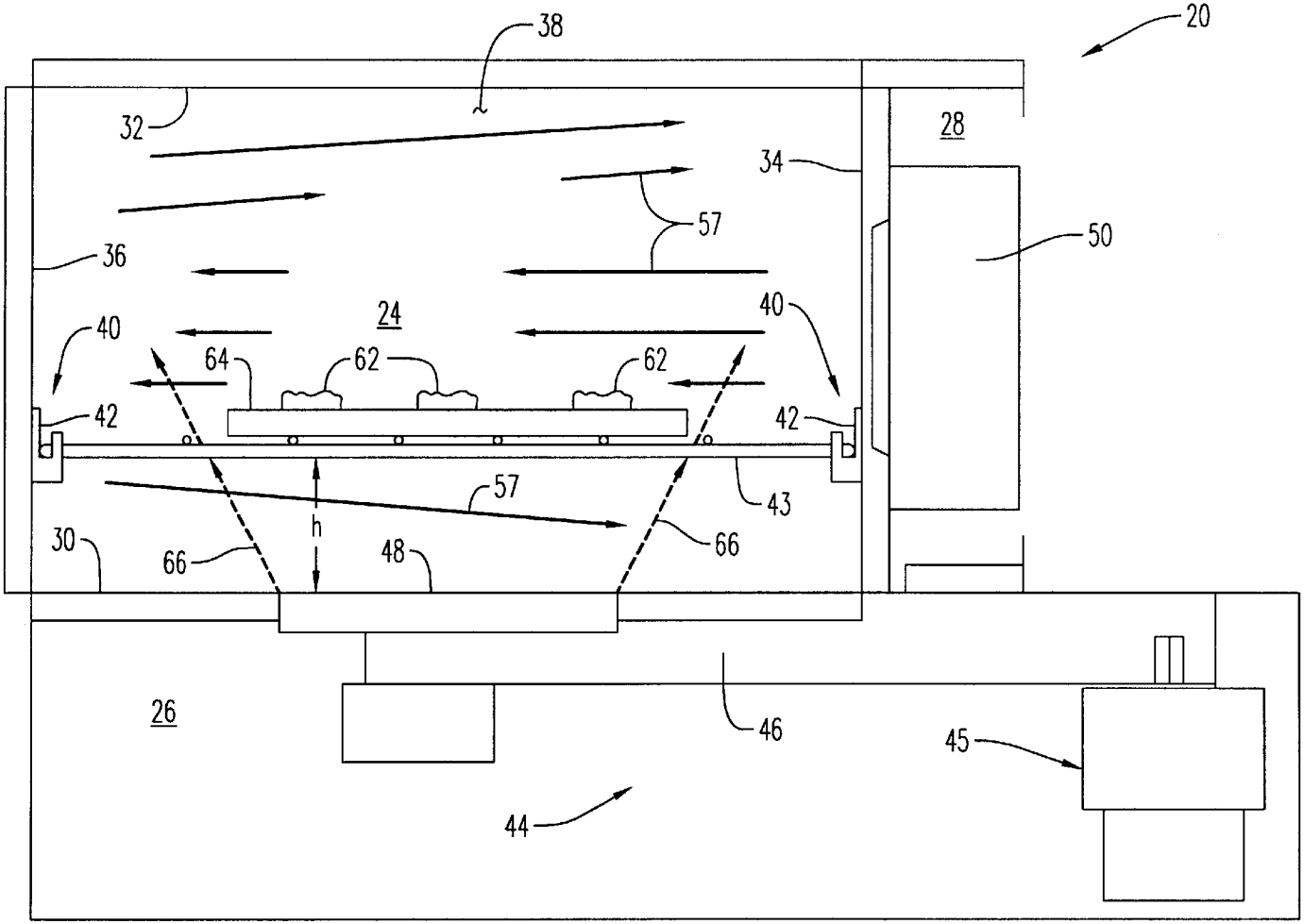
FIG. 2 is a view taken along line 2—2 of FIG. 1.

Referring to FIGS. 1 and 2, an oven 20 has an enclosure 22 that houses a cooking chamber 24, a bottom chamber 26 and a side chamber 28. Cooking chamber 24 includes a bottom 30, a top 32, a pair of sides 34 and 36 and a back 38. A rack suspension system 40 includes brackets 42 that are mounted to sides 34 and 36. Rack suspension system 40 holds a rack 43 at a height h above bottom 30.

Figure 4:
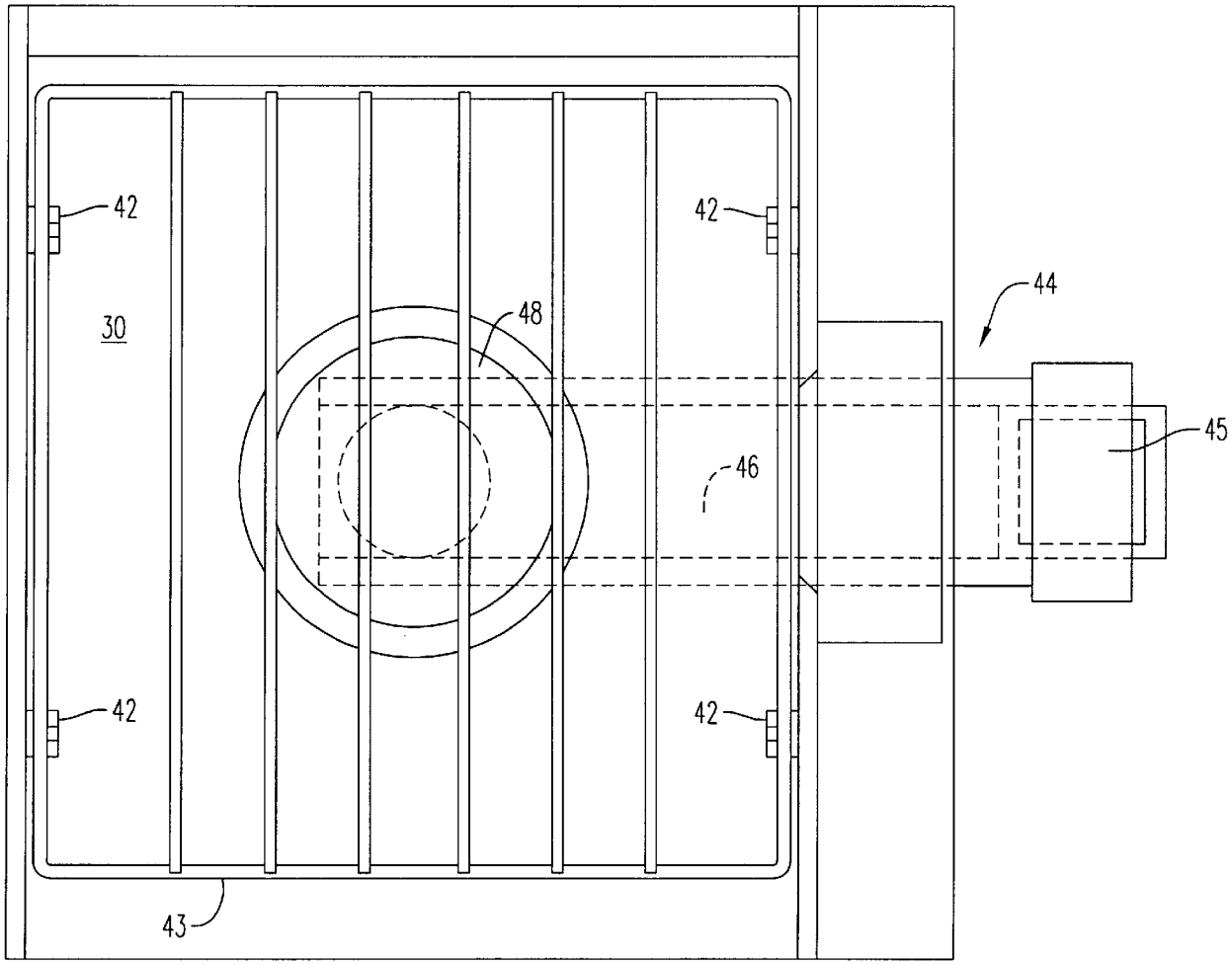
FIG. 4 is a view taken along line 4—4 of FIG. 1.

Referring to FIGS. 2 and 4, bottom chamber 26 contains a source of microwave energy 44 that includes a microwave emitter 45 and a wave guide 46 for directing microwave energy from microwave emitter 45 to cooking chamber 24 via an opening 48 in bottom 30.

Figure 3:
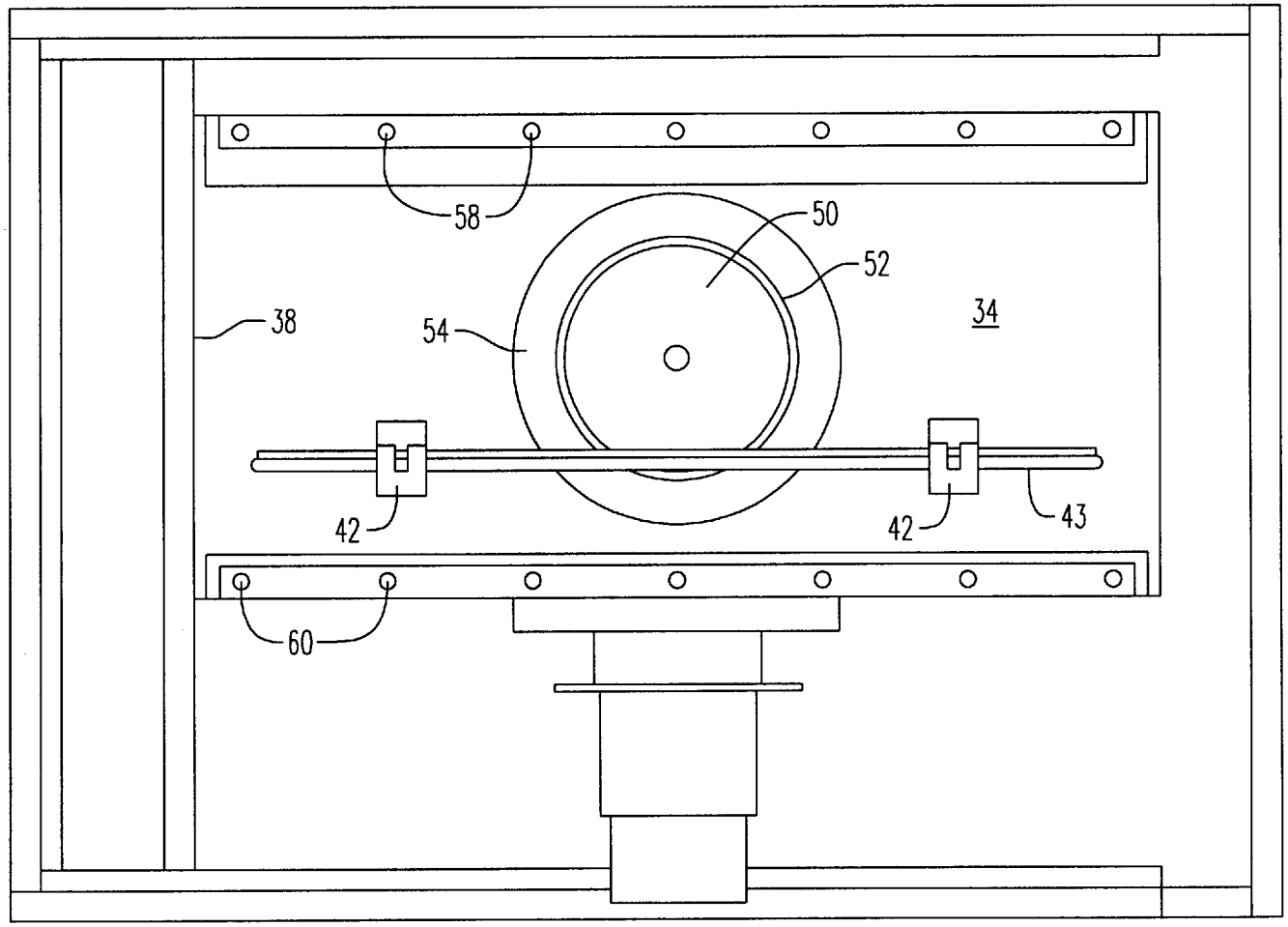
FIG. 3 is a view taken along line 3—3 of FIG. 1.

Referring to FIGS. 2 and 3, a blower 50 is mounted in side chamber 28 to blow a heated airflow 57 (solid arrows in FIG. 2) into cooking chamber 24 via an opening 52 in side 34 thereof. In particular, blower 50 is mounted to side 34 with a mounting plate 54 and suitable fasteners (not shown). Blower 50 includes a thermal energy source (not shown) to heat airflow 57.

Heated airflow 57 travels across cooking chamber 24 and is reflected by side 36 back to upper return port areas 58 and lower return port areas 60 in side 34. Heated airflow 57 heats by convection the sides and tops of food products 62 contained in a shallow pan or other cooking container 64 situated on rack 43. Alternatively, in the case of some food products, such as pizza, food products 62 can be cooked directly on rack 43. Food products 62, may be any food product. However, the invention is especially suitable for cooking frozen food products, such as bakery products like biscuits, buns, muffins, pizzas, pies and the like.

Microwave energy 66 (dashed arrows in FIG. 2) is directed upward from opening 48 in bottom 30 in a generally cone shaped pattern. Whether cooking with or without pan 64, microwave energy 66 is reflected by top 32, sides 34 and 36, back 38 and bottom 30 of cooking chamber 24 to impinge upon food products on their sides and tops.

A feature of the invention is that pan 64 can be either microwave transparent or reflective (e.g., metallic) and held by rack suspension system 40 on rack 43 in the near field of microwave energy 66. That is, the location or height h of pan 64 is selected so that pan 64 is within the generally conical pattern. If a microwave reflective pan is used, microwave energy 66 is both reflected by the bottom of pan 64 and also directed by the edges of pan 64. Microwave energy 66 also heats the bottom of pan 64, which transfers the heat to the bottoms of food products 62.

It has been discovered that the height h from the top of microwave energy source 44 to the top of rack 43 is important for cooking with a microwave reflective pan. The height h should be in the range of about 2.5 inches to about 3.5 inches, more preferably about 2.75 inches to about 3.25 inches, and most preferably about 2.875 inches.

It will be apparent to those skilled in the art, that the direction of forced hot airflow in cooking chamber 24 can be reversed. That is, hot air can enter cooking chamber 24 via apertures 58 and 60 and leave via opening 52. Also, it will be apparent to those skilled in the art that combination blower/heater 50 may be a separate blower and one or more separate heater elements situated in side chamber 28.

Figure 5:
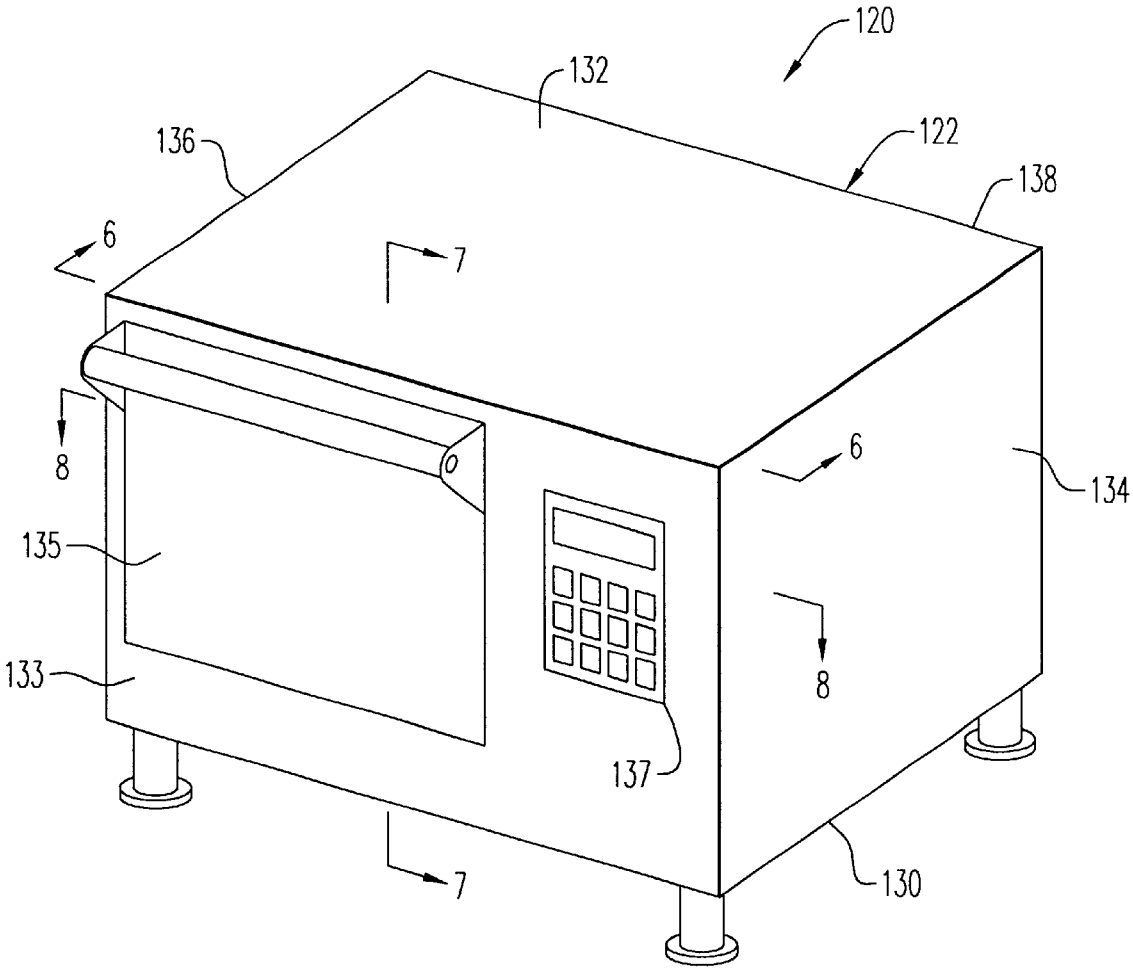
FIG. 5 is a perspective view of another embodiment of a combination convection/microwave oven of the present invention.
Figure 6:
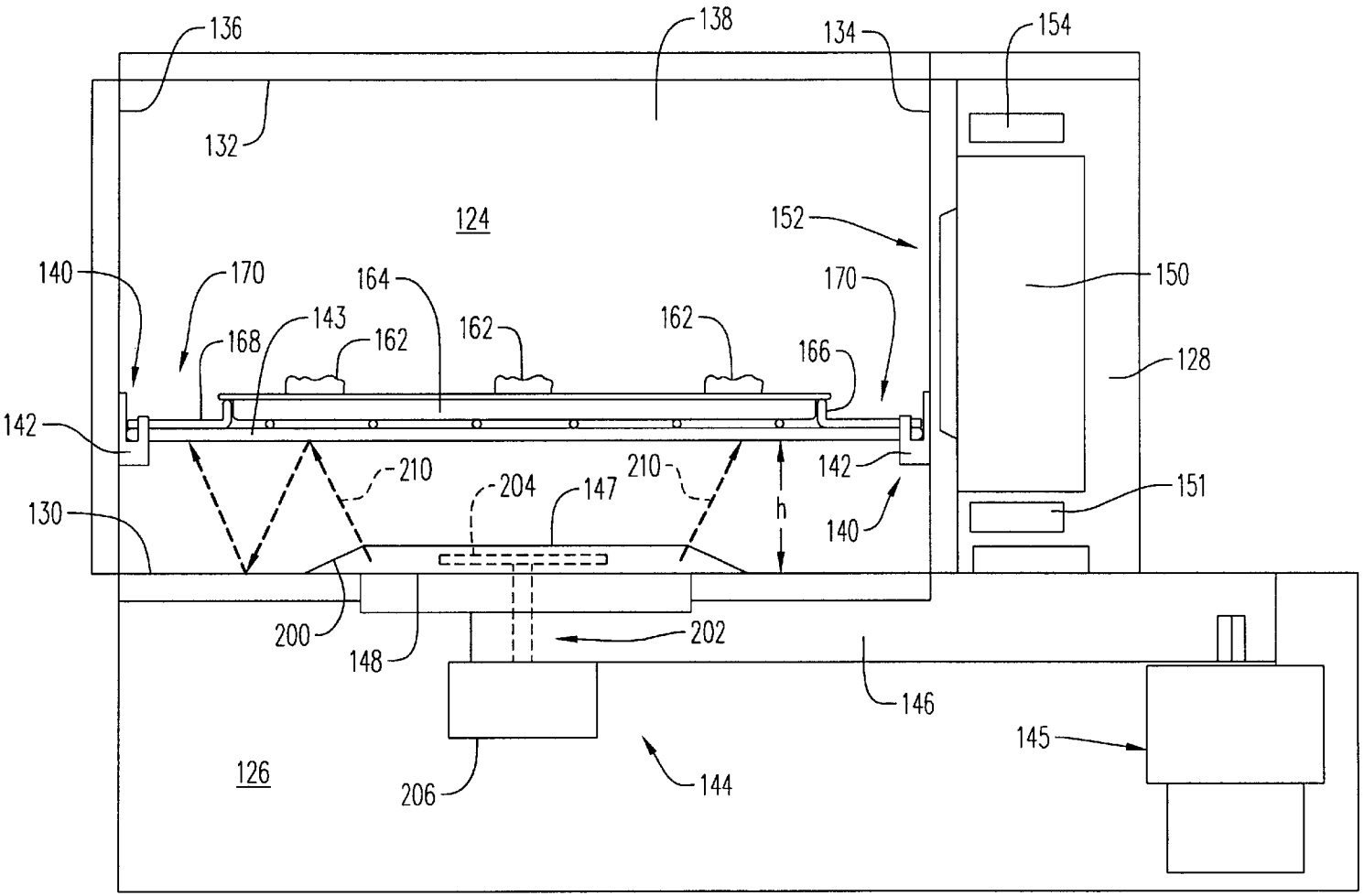
FIG. 6 is a view taken along line 6—6 of FIG. 5.

Referring to FIGS. 5 and 6, another embodiment of the present invention is shown as an oven 120 that has an enclosure 122. Enclosure 122 houses a cooking chamber 124, a bottom chamber 126 and a side chamber 128. Enclosure 122 has a front 133 that has a door 135 and a control panel 137. Cooking chamber 124 includes a bottom 130, a top 132, a pair of sides 134 and 136 and a back 138. A rack suspension system 140 includes brackets 142 that are mounted to sides 134 and 136 and hold a rack 143 at a height h above bottom 130. Rack suspension system 140 can alternatively be mounted to cooking chamber top 132 or to cooking chamber bottom 130 in a manner to support rack 143 at height h above bottom 130.

Control panel 137 is operative to place oven 120 in a normal cook mode or a fast cook mode. When in a normal cook mode, cooking chamber 124 is supplied with convection heat only to cook the food products in a normal cook time. When oven 120 is in a fast cook mode, cooking chamber 124 is supplied with both convection heat and microwave heat to cook the food products in a shorter time.

Figure 8:
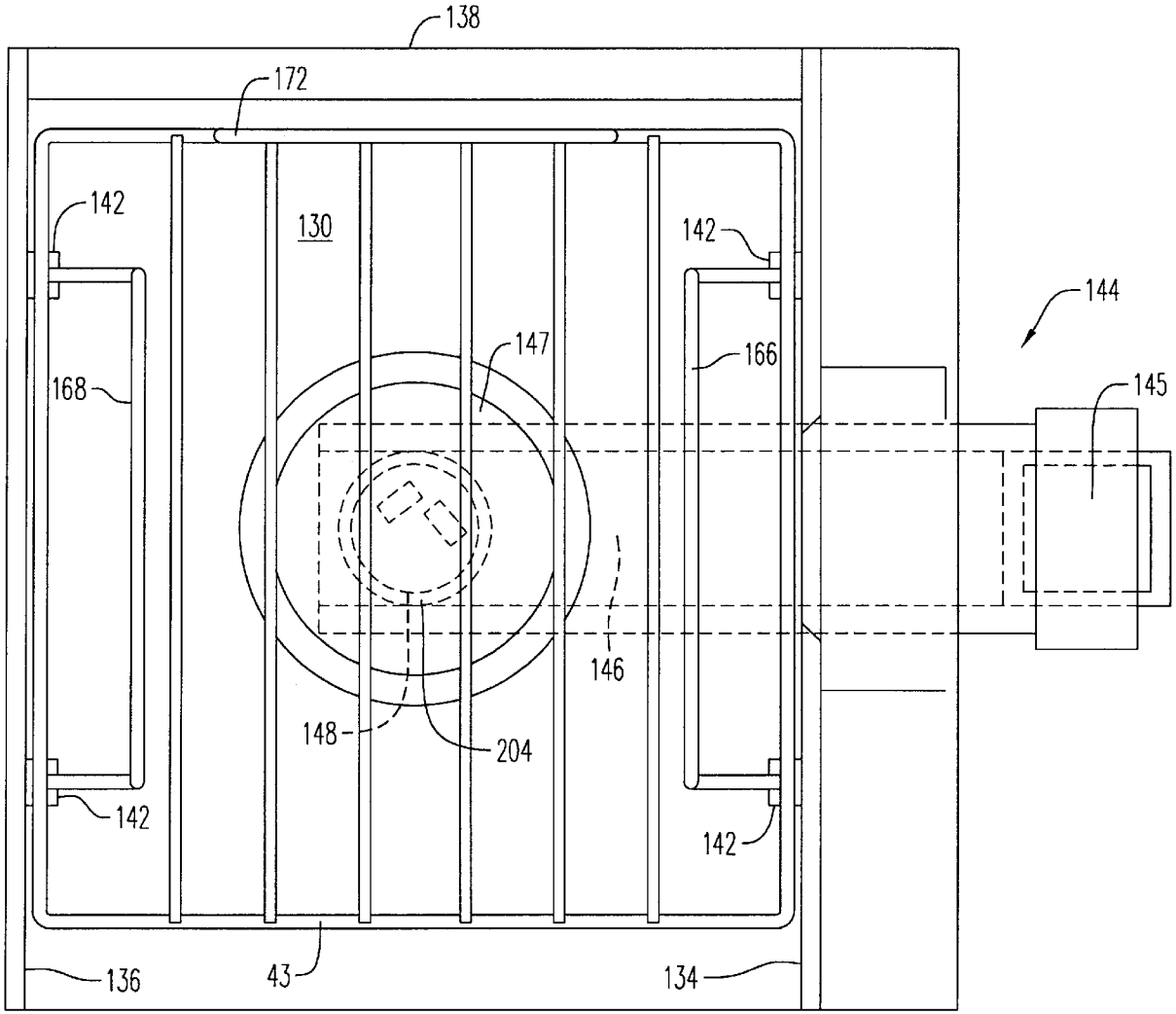
FIG. 8 is a view taken along line 8—8 of FIG. 5.

Referring to FIGS. 6 and 8, bottom chamber 126 contains a source of microwave energy 144 that includes a microwave emitter 145 and a wave guide 146 for directing microwave energy from microwave emitter 145 to cooking chamber 124 via an opening 148 in bottom 130. A microwave transparent cover 147 is disposed over opening 148.

Figure 7:
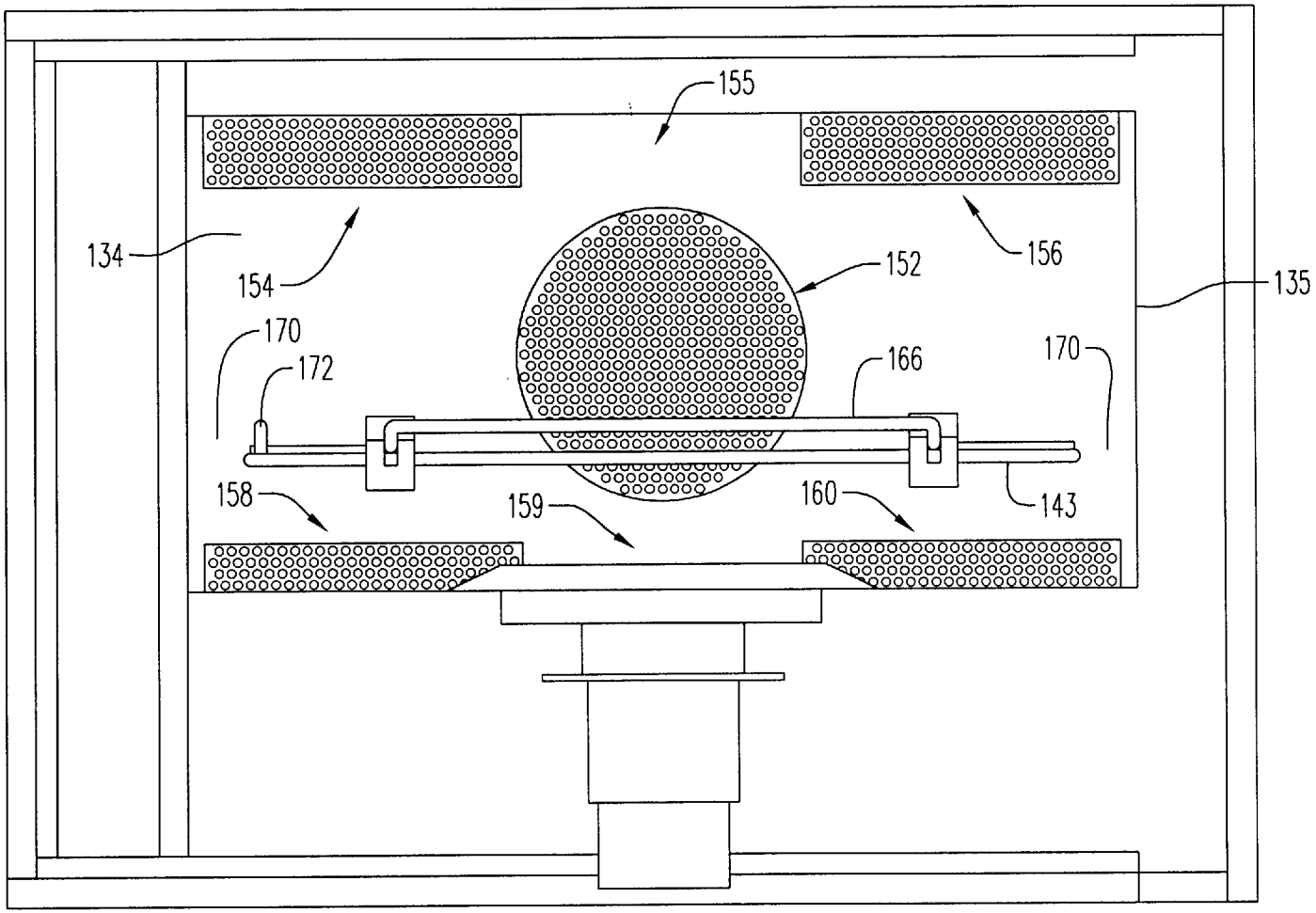
FIG. 7 is a view taken along line 7—7 of FIG. 5.

Referring to FIG. 6, a combination blower 150 is mounted in side chamber 128 adjacent to an egress port area 152 in side 134 of cooking chamber 124. In particular, blower 150 is mounted to side 134 with a mounting plate (not shown) and suitable fasteners (not shown). Referring to FIG. 7, a pair of upper ingress ports 154 and 156 are disposed above egress port area 152. A space 155 disposed above egress port area 152 separates ingress ports 154 and 156. A pair of lower ingress port areas 158 and 160 are disposed below egress port area 152. A space 159 disposed below egress port area 152 separates ingress port s 158 and 160. One or more heater elements 151 are located in side chamber 128 to heat the airflow.

Referring to FIGS. 6 and 7, blower 150 circulates heated air between cooking chamber 124 and side chamber 128. The heated air enters cooking chamber 124 via upper ingress ports 154 and 156 and via lower ingress ports 158 and 160. The heated air travels across cooking chamber 124, is reflected by the opposite side 136 and returns to exit cooking chamber 124 via egress port area 152. The heated airflow heats by convection the sides and tops of one or more food products 162 contained in a shallow pan or other cooking container 164 situated on rack 143. Alternatively, in the case of some food products, such as pizza, food products 162 can be cooked directly on rack 143. The food products 162 may be any food products. However, oven 120 is especially suitable for cooking frozen food products, such as bakery products like biscuits, buns, muffins, pizzas, pies and the like.

Referring to FIGS. 6–8, rack 143 has a pair of side guides 166 and 168 and a back guide 172. Side guides 166 and 168 and back guide 168 hold pan 164 in a position on rack 143 so as to leave a space 170 between pan 164 and sides 134 and 136, front door 133 and back 138. Side guides 166 and 168 and back guide 172 may alternatively be any shape or size attached or formed integrally on rack 143 or be attached or formed integrally to sides 134 and 136 and back 138, respectively. In other embodiments, side guides 166 and 168 and back guide 172 may be part of a frame or tray in which pan 164 seated so as to provide space 170 between pan 164 and sides 134 and 136, back 138 and front 133.

Figure 9:
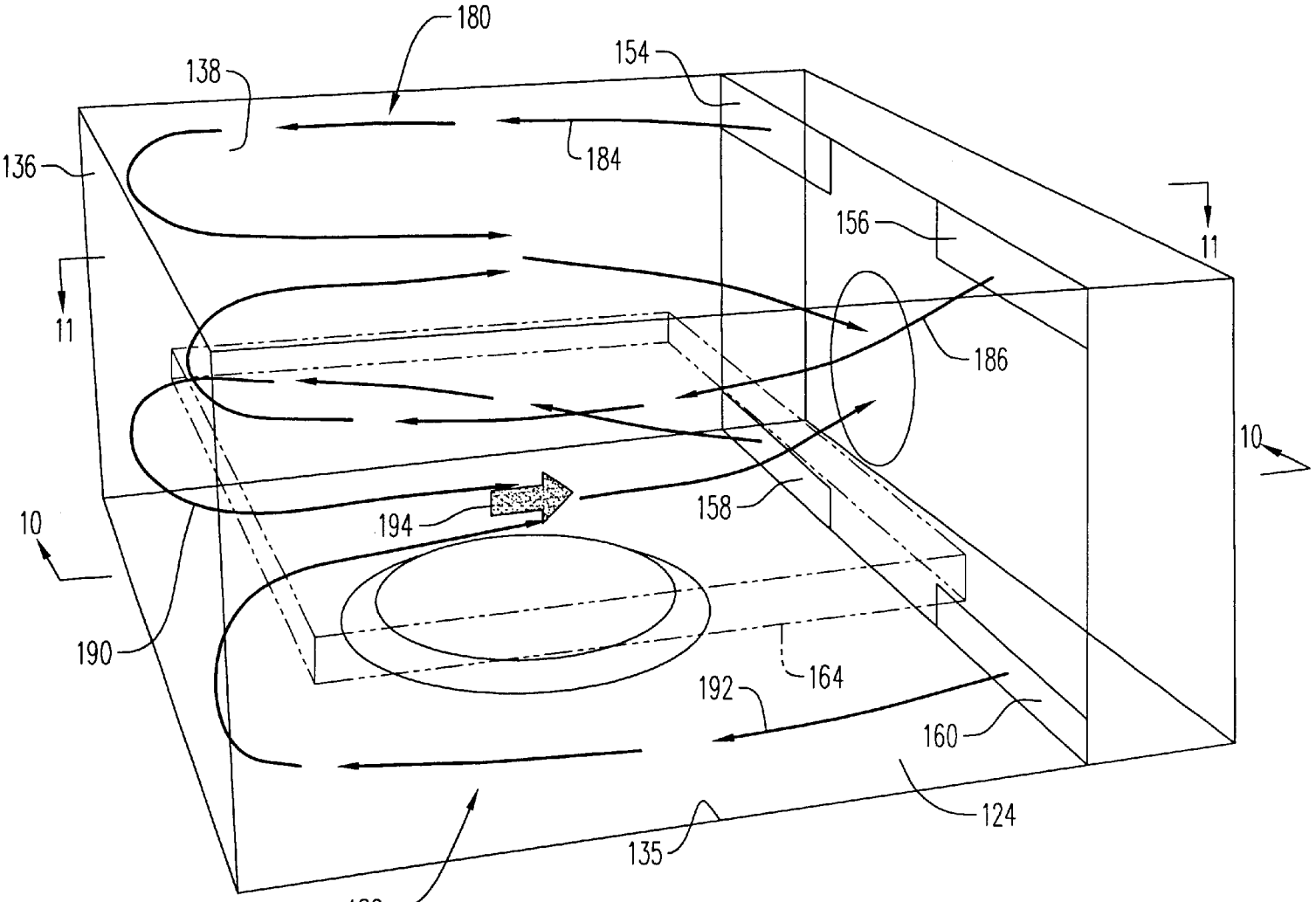
FIG. 9 is a skeletal perspective view of the oven chamber depicting the laminar airflow for the oven of FIG. 5.
Figure 10:
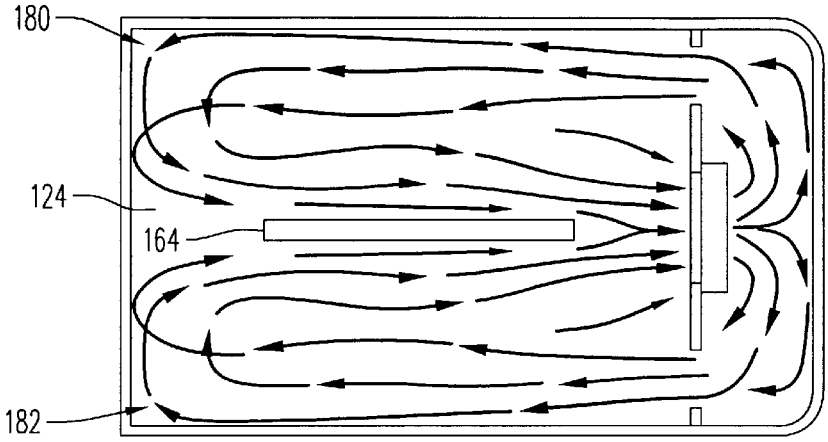
FIG. 10 is view taken along the line 10—10 of FIG. 9.
Figure 11:
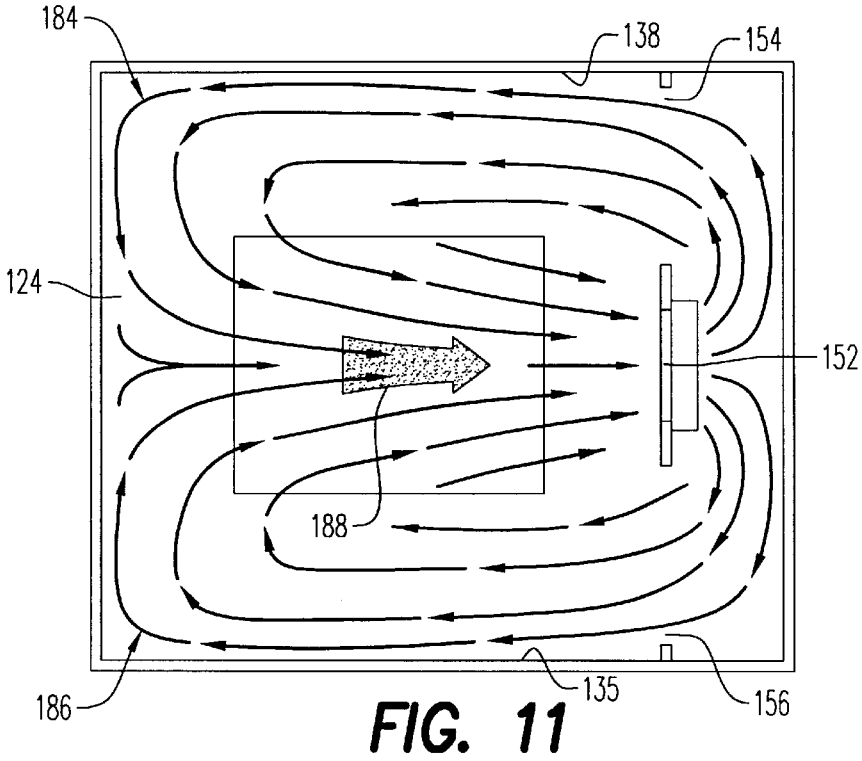
FIG. 11 is a view taken along line 11—11 of FIG. 9.

Referring to FIGS. 9–11, the airflow pattern in cooking chamber 124 is laminar. The laminar airflow pattern has an upper laminar air stream 180 and a lower laminar air stream 182, as shown in FIG. 10. With reference to FIGS. 9 and 11, upper laminar air stream 180 has a first airflow loop 184 and a second airflow loop 186. In airflow loop 184, air enters cooking chamber 124 via upper port 154 travels along back 138 toward side 136, is reflected by side 136 to return to egress port area 152 along a common path, shown generally by arrow 188 in FIG. 11. In airflow loop 186, air enters cooking chamber 124 via upper port 156 travels along front door 135 toward side 136, is reflected by side 136 to return to egress port area 152 along common path 188.

With reference to FIG. 9, lower laminar air stream 182 has a first airflow loop 190 and a second airflow loop 192. In airflow loop 190, air enters cooking chamber 124 via lower port 158 and travels along back 138 toward side 136, where it is reflected by side 136 to return to egress port area 152 along a common path, shown generally by arrow 194 in FIG. 9. In airflow loop 192, air enters cooking chamber 124 via lower port 160 and travels along front door 135 toward side 136, where it is reflected by side 136 to return to egress port area 152 along common path 194.

As shown in FIGS. 9–11, pan 164 is positioned at the interface of upper laminar air stream 180 and lower laminar air stream 182. This position maximizes thermal transfer from the heated air to food products 162. Food products 162 are directly in the path of airflow loops 184 and 186 of upper laminar air stream 180. The bottom of pan 164 is in the path of airflow loops 190 and 192 of lower laminar air stream 182. Referring to FIG. 6, cover 147 has a sloped edge 200 that deflects air of lower airflow layer 182 slightly upward, thereby enhancing thermal transfer to the bottom of pan 164.

Figure 12:
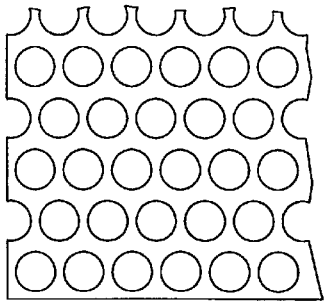
FIG. 12 is a plan view of a portion of a perforated area of FIG. 7.

Referring to FIG. 12, egress port area 152 has a plurality of apertures 195 and each of the ingress ports 154, 156, 158 and 160 has a plurality of apertures 198. Each of the apertures 196 and 198 has an area small enough to prevent microwave energy from passing therethrough, but large enough to control and regulate airflow. Apertures 196 and 198 may have any suitable shape in cross-section, the maximum dimension of which is substantially less than a half of the free space wavelength of the microwave energy radiated into cooking chamber 124. For a circular cross-sectional shape, the aperture diameter is preferably less than a tenth of the free space wavelength of the microwave energy radiated into cooking chamber 124. For microwave energy having a free space wavelength of about 120 millimeters, the aperture diameter is approximately 0.156 inch and the apertures are staggered on centers that are approximately 0.1875 inch apart.

Referring to FIG. 12, a portion of egress port 154 has apertures 198 arranged in staggered rows and columns. Blower 150 develops a positive pressure in side chamber 128 adjacent upper ingress ports 154 and 156 and lower ingress ports 158 and 160. This positive pressure is tuned so as to straighten the air entering cooking chamber via ingress ports 154, 156, 158 and 160, thereby forming a more uniform laminar airflow.

Referring to FIGS. 6 and 8, a coupling structure 202 couples microwave energy 210 (dashed arrows in FIG. 6) upwardly from opening 148 in bottom 130 in a generally cone shaped pattern. Coupling structure 202 includes a plate 204 and a motor 206 that rotates plate 20 to provide a uniform transfer of microwave energy 210 into cooking chamber 124 so as to even out hot spots over each revolution thereof. Part of the microwave energy 210 heats the bottom of pan 164, which transfers the heat to the bottoms of food products 162.

Figure 13:
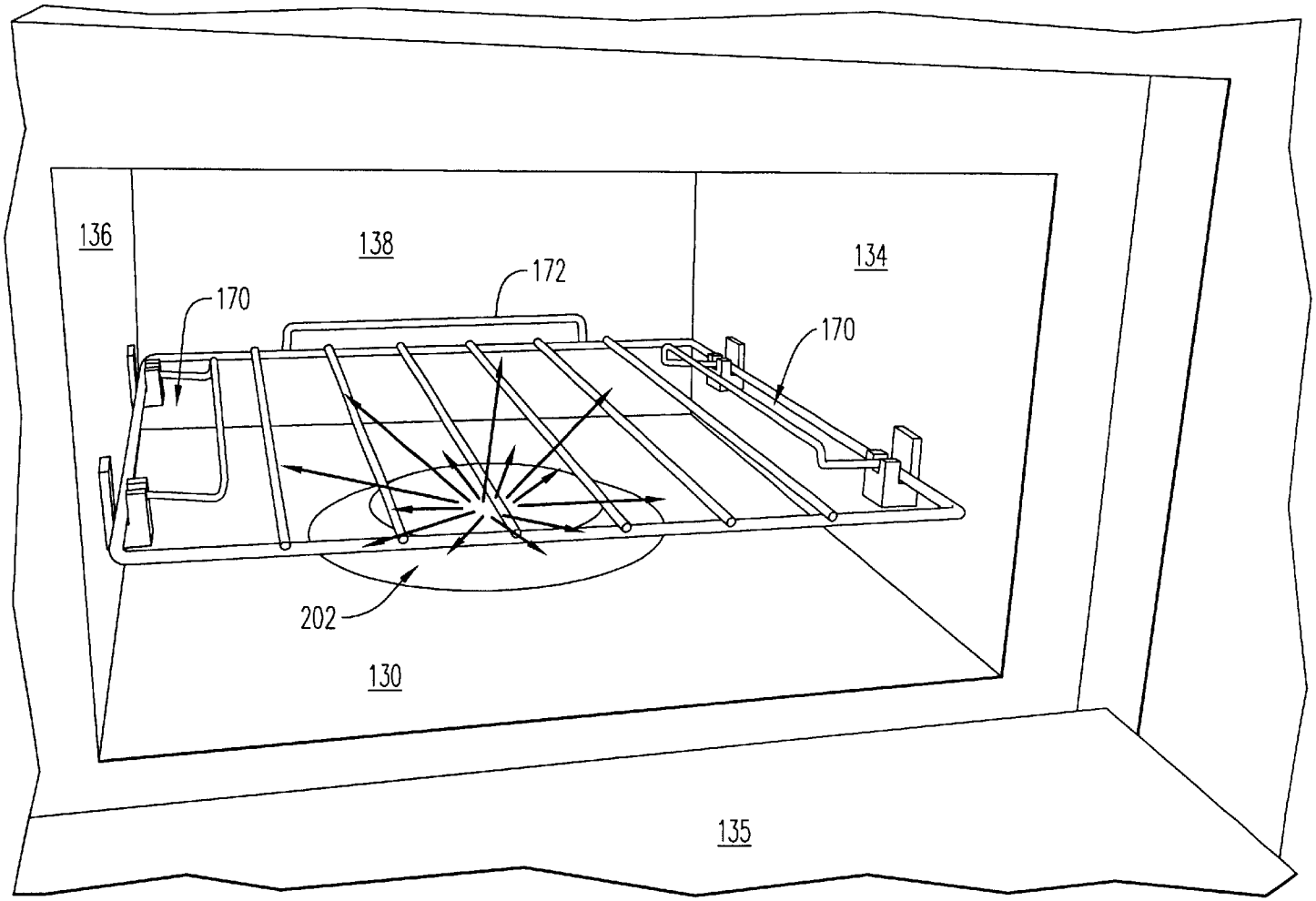
FIG. 13 is a perspective view of a portion of the oven of FIG. 5 with the oven door open depicting the microwave radiation without a cooking pan.
Figure 14:
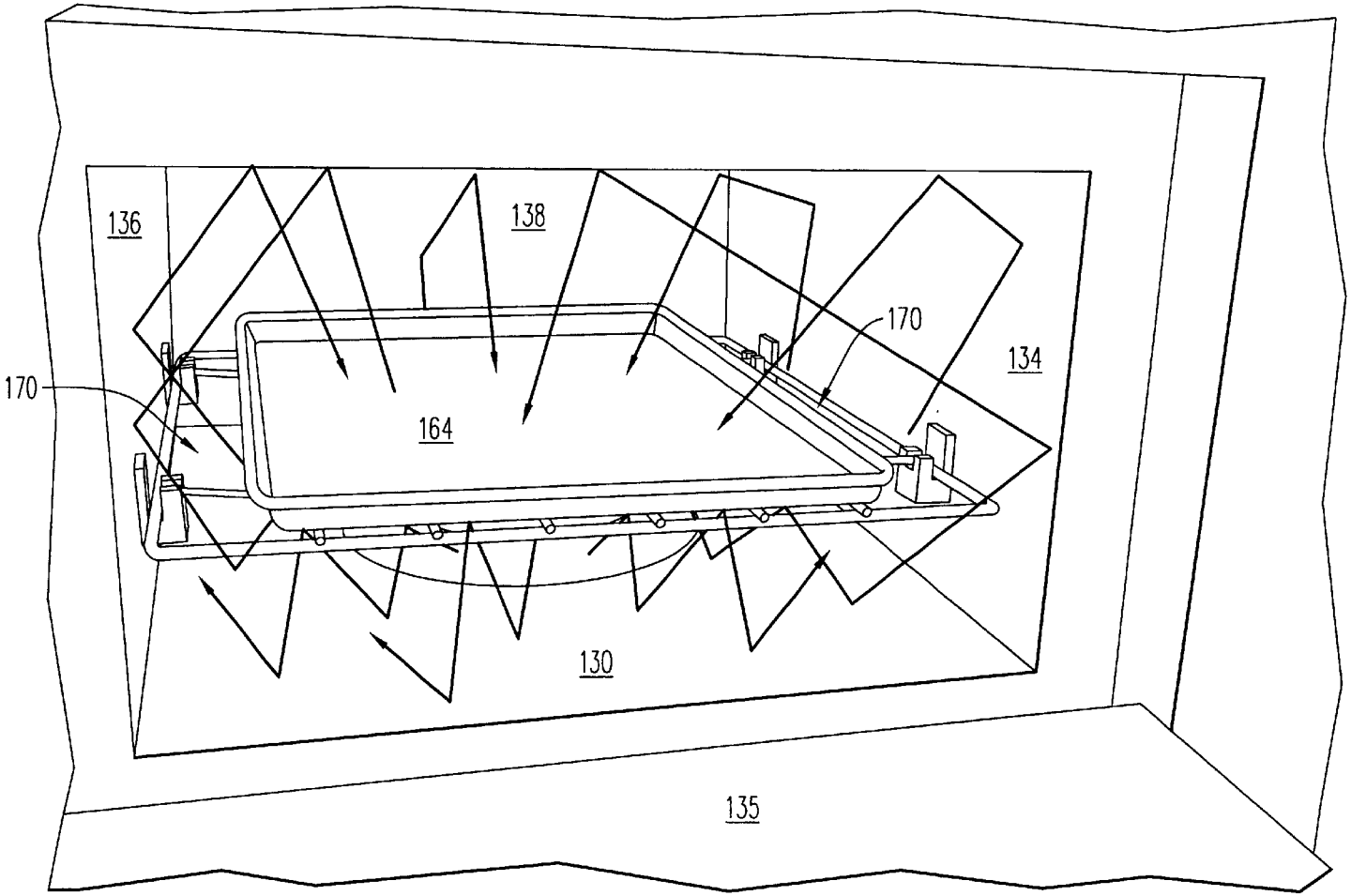
FIG. 14 is a perspective view of a portion of the oven of FIG. 5 with the oven door open depicting the microwave radiation with a cooking pan.

Referring to FIGS. 6, 13 and 14, the bottom of pan 164 and the bottom 130 of cooking chamber 124 form a random waveguide that directs microwave energy 210 via space 170 to the region above rack 143. The random wave guide action is illustrated by the dashed arrows in FIG. 6 and by the solid arrows in FIG. 13. Thus, microwave energy 210 reflects back and forth between the bottom of pan 164 and the bottom 130 of cooking chamber 124 and is reflected by side 134, back 138, side 136, front door 135 and top 132 to thereby cook the tops and sides of food products 162.

Rack suspension system 140 holds rack 143 in the near field of microwave energy 210. That is, the location or height h of pan 164 is selected so that pan 164 is within the generally conical pattern. It has been discovered that the height h from the top of microwave energy source 144 to the top of rack 143 is important for cooking with a microwave reflective pan to obtain random wave guide action. The height h should be in the range of about 2.0 inches to about 3.5 inches, more preferably about 2.5 inches to about 3.25 inches, and most preferably about 2.875 inches.

Figure 15:
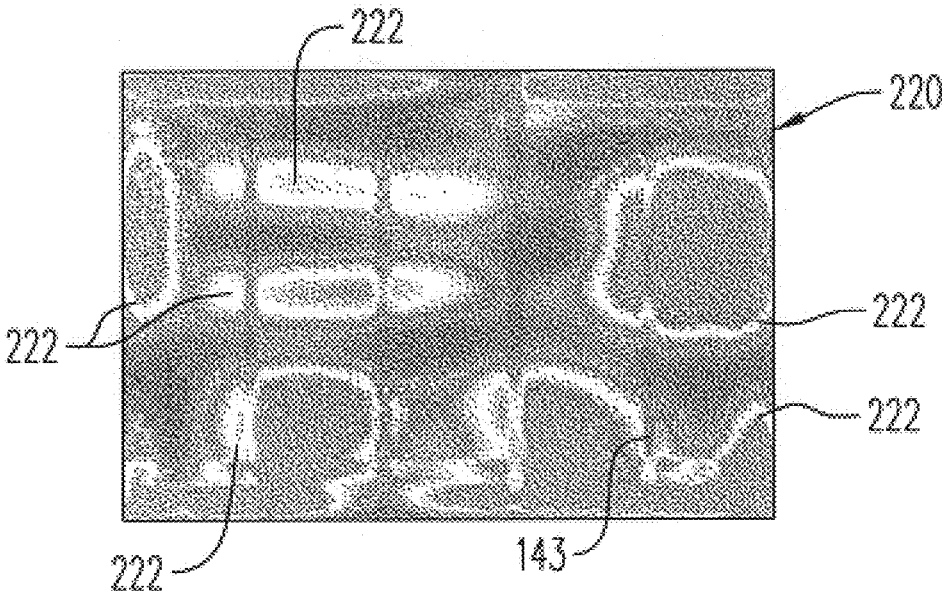
FIGS. 15 and 16 depict heat patterns in the oven of FIG. 5.
Figure 16:
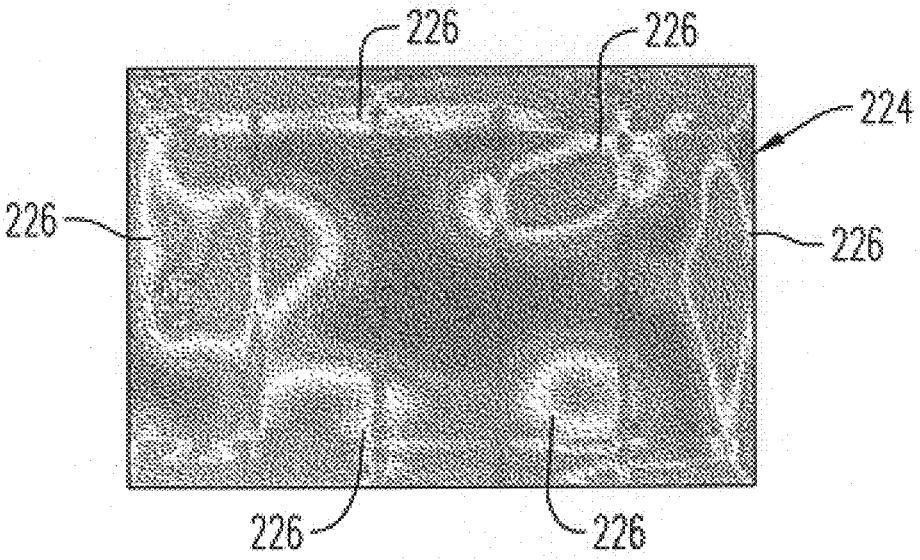

Referring to FIG. 15, a heating pattern 220 above rack 143 has maximum heating areas 222 for a rotational position of plate 204. As plate 204 rotates, the maximum heating areas, such as areas 222, dynamically change so as to provide an evening of hot spots incident on food products 162 during each revolution of plate 204. For example, FIG. 16 shows a heating pattern 224 for a rotational position of plate 204 that is displaced by 45° from that of FIG. 15. Heating pattern 224 has maximum heating areas 226 that are situated in different locations than maximum heating areas 222 of FIG. 15, thereby resulting in a dynamic movement of hot an cold spots to even out their effect on food products 162. It has been discovered that the distance between the top of pan 164 and top 132 of cooking chamber for best results should be at least about 1.5 times the free-space wavelength of about 120 mm.

To maximize reflected microwave energy, bottom 130, top 132, door 135 and sides 134 and 136 are constructed with a highly microwave reflective material.

The present invention having been thus described with particular reference to the preferred forms thereof, it will be obvious that various changes and modifications may be made therein without departing from the spirit and scope of the present invention as defined in the appended claims.

What is claimed is:

1. A combination oven for cooking a food product with microwave energy and hot air comprising:

a cooking chamber and a plenum disposed in a side wall of said cooking chamber such that said plenum is in fluid communication with said cooking chamber via an air egress port area and an air ingress port area disposed in a side wall thereof;

a source of energy, which is capable of introducing said microwave energy into said cooking chamber;

a food rack capable of holding said food product within said cooking chamber; and means for heating and circulating an airflow through said cooking chamber and said plenum to develop a laminar airflow pattern in said cooking chamber, wherein said laminar airflow pattern has a first laminar air stream that is above said food rack and a second laminar air stream that is below said food rack, wherein at least one of said first and second laminar air streams has first and second loops that share a common path toward said air egress port area, and wherein said ingress port area comprises an upper port area and a lower port area that are separated from one another such that said first and second laminar air streams circulate substantially through said upper and lower port areas, respectively.

2. The combination oven of claim 1, wherein said air ingress port area is dimensioned so that a pressure developed in said plenum is high enough to substantially straighten said airflow in said first and second laminar air streams, whereby said food product is cooked by both said microwave energy and said heated airflow.

3. The combination oven of claim 1, Wherein said common path is a first common path, and wherein the other of said first and second laminar air streams has first and second loops that share a second common path toward said egress port area.

4. A combination oven for cooking a food product with microwave energy and hot air comprising:

a cooking chamber and a plenum disposed in a side wall of said cooking chamber such that said plenum is in fluid communication with said cooking chamber via an air egress port area and an air ingress port area disposed in a side wall thereof;

a source of energy, which is capable of introducing said microwave energy into said cooking chamber;

a food rack capable of holding said food product within said cooking chamber; and means for heating and circulating an airflow through said cooking chamber and said plenum to develop a laminar airflow pattern in said cooking chamber, wherein said laminar airflow pattern has a first laminar air stream that is above said food rack and a second laminar air stream that is below said food rack, and wherein at least one of said first and second laminar air streams has first and second loops that share a common path toward said air egress port area, wherein said common path is a first common path, and wherein the other of said first and second laminar air streams has first and second loops that share a second common path toward said egress port area, wherein said side wall is a first side wall of a pair of opposed side walls, wherein said ingress port area is one of a plurality of ingress port areas disposed in said first side wall, and wherein said airflow in said first and second loops of each of said first and second laminar air streams is from said plurality of ingress port areas toward a second side of said pair of opposed sides and then to said egress port area via said first and second common paths.

5. The combination oven of claim 4, wherein said plurality of ingress port areas includes first and second ports located above said rack and third and fourth ports located below said rack.

6. The combination oven of claim 5, wherein said first and second ports are separated by a first space, and wherein third and fourth ports are separated by a second space.

7. The combination oven of claim 6, wherein said first and second spaces are disposed above and below said egress port area, respectively.

8. The combination oven of claim 5, wherein each of said first and second ports has a first number of apertures, and wherein each of said third and fourth ports has a second number of apertures.

9. The combination oven of claim 8, wherein said first number is larger than said second number.

10. A combination oven for cooking a food product with microwave energy and hot air comprising:

a cooking chamber having a plurality of walls that are highly reflective to microwave energy, said walls including a top, a bottom and a plurality of sides;

a plenum disposed in a first of said side walls such that said plenum is in a fluid communication with said cooking chamber via an air egress port area and an ingress port area disposed in said first side wall;

a source of energy, which is capable of introducing said microwave energy into said cooking chamber from said bottom;

a food rack capable of being positioned above said bottom of said cooking chamber and a guide disposed on said food rack in a manner to provide a substantially uniform spacing between said guide and said plurality of side walls of said cooking chamber, wherein a random wave guide is formed by a bottom of a microwave reflective pan, when positioned by said guide on said rack, and said bottom of said cooking chamber to guide said microwave energy through said spacing into a region above said pan, wherein said microwave energy guided into said region is further reflected by said plurality of side walls and/or said top of said cooking chamber to cook said food product in said pan; and means for heating and circulating an airflow through said cooking chamber and said plenum to develop an airflow in said cooking chamber that additionally cooks said food product by hot air convection.

11. The combination oven of claim 10, wherein said food rack is positioned in a near field of said microwave energy introduced into said cooking chamber via said bottom.

12. The combination oven of claim 10, further comprising a coupler that introduces said microwave energy into said cooking chamber in a manner that substantially provides uniform cooking of said food product.

13. The combination oven of claim 12, wherein said coupler introduces said microwave energy into said cooking chamber in a manner that evens the effect of hot and/or cold spots created by said microwave energy while said food product is being cooked.

14. The combination oven of claim 12, wherein said coupler dynamically changes the heat pattern of said microwave energy so as to substantially uniformly cook said food product.

15. The combination oven of claim 10, said guide is dimensioned to position said pan in a location so as to provide said spacing with respect to said at least three of said plurality of side walls.

16. The combination oven of claim 15, wherein said guide includes one or more members that extend above said food rack.

17. The combination oven of claim 15, wherein said guide includes one or more members that are connected to said rack.

18. The combination oven of claim 10, further comprising support means for holding said rack at a height in the range of about 2 inches to about 3.2 inches above said bottom of said cooking chamber.

19. The combination oven of claim 18, wherein said height is about 2.875 inches.

20. A combination oven for cooking a food product with microwave energy and hot air comprising:

a cooking chamber having a plurality. of walls that are highly reflective to microwave energy, said walls including a top, a bottom and a plurality of sides;

a plenum disposed in a first of said side walls such that said plenum is in a fluid communication with said cooking chamber via an air egress port area and an ingress port area disposed in said first side wall;

a source of energy, which is capable of introducing said microwave energy into said cooking chamber from said bottom;

a food rack capable of being positioned above said bottom of said cooking chamber in a near field of said microwave energy such that when a microwave reflective pan containing said food product is situated on said rack, a random wave guide is formed by a bottom of said pan and said bottom of said cooking chamber to guide said microwave energy through a spacing between said pan and said plurality of side walls of said cooking chamber into a region above said pan, wherein said microwave energy guided into said region is further reflected by said plurality of side walls and/or said top of said cooking chamber to cook said food product in said pan; and means for heating and circulating an airflow through said cooking chamber and said plenum to develop a laminar airflow that additionally cooks said food product by hot air convection, wherein said laminar air flow includes first and second laminar air streams above and below said pan, wherein said fluid communication is established by an egress port area and a plurality of ingress port areas that are arranged on said first side wall so that said each of said first and second laminar air streams has first and second loops that share first and second common paths, respectively, toward said egress port area, wherein a second side wall of said plurality of side walls is opposed to said first side, and wherein said air flow in said first and second laminar air streams is from said plurality of ingress port areas toward said second side and then to said egress port area via said first and second common paths.

21. The combination oven of claim 20, wherein said plurality of ingress ports includes first and second ports located above said rack and third and fourth ports located below said rack.

22. The combination oven of claim 21, wherein said first and second ports are separated by a first space, and wherein third and fourth ports are separated by a second space.

23. The combination oven of claim 22, wherein said first and second spaces are disposed above and below said egress port area, respectively.

24. The combination oven of claim 21, wherein each of said first and second ports has a first number of apertures, and wherein each of said third and fourth ports has a second number of apertures.

25. The combination oven of claim 24, wherein said first number is larger than said second number.

26. A method for cooking a food product with microwave energy and hot air in a cooking chamber of a combination microwave/convection oven, said method comprising:

(a) positioning a microwave reflective pan between a bottom of said chamber in a near field of said microwave energy so as to provide a substantially uniform spacing between said pan and a plurality of walls of said cooking chamber;

(b) directing said microwave energy between said bottom of said cooking chamber and said pan and through said spacing to a region above said pan; and (c) circulating said hot air above and below said pan.

27. The method of claim 26, wherein step (c) circulates said hot air in a laminar airflow having a first laminar air stream above said pan and a second laminar air stream below said pan, and wherein at least one of said first and second layers has first and second loops.

28. The method of claim 27, wherein step (c) circulates said hot air via a plurality of ingress port areas, and wherein said first and second loops share a common path toward an egress port area.

29. The method of claim 28, wherein said plurality of ingress port areas and said egress port area are located in one of said plurality of walls, and wherein said ingress port area comprises an upper port area and a lower port area that are separated from one another such that said first and second laminar air streams circulate substantially through said upper and lower port areas, respectively.

30. A method for cooking a food product with microwave energy and hot air in a cooking chamber of a combination microwave/convection oven, wherein said food product is at a level above a bottom of said cooking chamber, said method comprising:

(a) introducing said microwave energy into said cooking chamber;

(b) circulating said hot air in a laminar airflow having a first laminar air stream from an upper ingress port area above said level and a second laminar air stream from a lower ingress port area below said level, wherein said first and second air streams flow toward a common egress port area, and wherein at least one of said first and second laminar air streams has first and second loops.

31. The method of claim 30, wherein said upper and lower ingress port areas are separated from one another, and wherein said first and second loops share a common path toward said egress port area.

32. The method of claim 31, wherein said upper and lower ingress port areas and said egress port area are located in a side wall of said cooking chamber.

33. The method of claim 32, wherein each of said upper and lower ingress port areas includes first and second ingress ports separated by a distance and located in said side wall to produce said first and second loops.

34. A combination oven for cooking a food product comprising:

a cooking chamber having a plurality of walls that are highly reflective to microwave energy, said walls including a top, a bottom and a plurality of sides;

a control that places said oven in a normal cook mode or a fast speed cook mode.

a source of thermal energy disposed to introduce a forced hot airflow into said cooking chamber when said oven is in said normal cook mode and when said oven is in said fast cook mode a source of energy, which is capable of introducing microwave energy into said cooking chamber from said bottom when said oven is in said fast cook mode; and a food rack positioned above said bottom of said cooking chamber in a near field of said microwave energy such that when a microwave reflective pan containing said food product is situated on said rack, a random wave guide is formed by a bottom of said pan and said bottom of said cooking chamber to guide said microwave energy through a substantially uniform spacing between said pan and said plurality of sides of said cooking chamber into a region above said pan, wherein said microwave energy guided into said region is further reflected by said plurality of sides and/or said top of said cooking chamber to cook said food product in said pan.

35. The oven of claim 34, further comprising means for circulating said forced hot air via a fluid communication between said cooking chamber and a plenum, wherein said forced hot air flows over and under said pan.

36. The oven of claim 35, wherein said forced hot airflow is formed in a laminar pattern that has a fist laminar air stream above said rack and a second laminar air stream below said rack.

37. The oven of claim 36, wherein at least one of said laminar air streams has a pair of loops that share a common path toward an egress port area.

38. The oven of claim 34, wherein said rack is located above said bottom by a height that is in the range of about 2 inches to about 3.25 inches.

* * * * *